US006003268A

United States Patent [19]

Oruganty

[11] Patent Number: 6,003,268

[45] Date of Patent: Dec. 21, 1999

[54] WINDOW LIFT SYSTEM

[75] Inventor: Raghn K. Oruganty, Belleville, Mich.

[73] Assignee: UT Automotive Dearborn, Inc., Dearborn, Mich.

[21] Appl. No.: 08/890,189

[22] Filed: Jul. 9, 1997

[51] Int. Cl.[6] ..... E05F 11/44

[52] U.S. Cl. ..... 49/351; 49/349

[58] Field of Search ..... 49/351, 350, 349, 49/348, 502

[56] References Cited

U.S. PATENT DOCUMENTS

| | | | |
|---|---|---|---|
| 1,654,747 | 1/1928 | Nicholson | 49/351 |
| 2,115,632 | 4/1938 | Hanley | 268/132 |
| 2,336,530 | 12/1943 | Chandler et al. | 268/124 |
| 2,883,780 | 4/1959 | Goodman | 39/6 |
| 4,119,341 | 10/1978 | Cook | 296/146 |
| 4,170,847 | 10/1979 | Pickles | 49/349 |
| 4,235,117 | 11/1980 | Pickles | 74/89.2 |
| 4,353,185 | 10/1982 | Saigne | 49/351 |
| 5,015,030 | 5/1991 | Detloff | 49/351 X |
| 5,101,596 | 4/1992 | Moore | 49/351 |
| 5,337,519 | 8/1994 | Bergesio | 49/351 |

FOREIGN PATENT DOCUMENTS

| | | | |
|---|---|---|---|
| 944860 | 12/1963 | United Kingdom | 49/351 |

*Primary Examiner*—Jerry Redman
*Attorney, Agent, or Firm*—Howard & Howard

[57] ABSTRACT

A window lift system generally comprises a motor driving a threaded shaft threadably engaging a nut slidably mounted in a bracket. A link has a first end rotatably mounted to the nut and a second end rotatably mounted to an end of a pivotally mounted arm. An opposite end of the arm engaging the window glass raises and lowers the window glass as the arm pivots.

7 Claims, 5 Drawing Sheets

WINDOW LIFT SYSTEM

BACKGROUND OF THE INVENTION

The present invention relates generally to window lift system and more particularly to a window lift system using a screw drive.

Current window lift systems generally comprise a first arm pivotally mounted between a first end supporting a window glass and a second end having a 90° sector of gear teeth. The gear teeth engage a spur gear which is coupled to a worm gear driven by a worm driven by a motor. The motor drives the worm, worm gear and spur gear rotatably, thereby causing the first arm to pivot. The pivoting of the first arm raise and lower the window glass. A second arm is typically pivotally mounted to the first arm between the first end and pivot point of the first arm. A first end of the second arm supports the window glass while an opposite second end of the second arm is pivotally mounted to a slide which freely slides forwardly and rearwardly during the raising and lowering of the window.

The known window lift system has low efficiency, due to the low efficiency of the worm/worm gear engagement. Further, the cost of the known system is relatively high, due to the number of gears.

SUMMARY OF THE INVENTION

The present invention provides an improved window lift system which is simplified, has a reduced number of parts and exhibits increased efficiency.

In a first embodiment, the window lift motor rotatably drives a threaded shaft which threadably engages an internally threaded nut, which in turn engages a second end of a first arm pivotally mounted between first and second ends. Preferably, a link has a first end rotatably mounted to the nut and an opposite second end rotatably mounted to the second end of the first arm. The nut is slidably mounted in a guide in a bracket to which the motor is fixedly mounted and in which the first arm is pivotally mounted. Preferably, the motor includes a two-stage coupled epicyclic gear unit which provides an increase in torque for driving the threaded shaft.

In operation, rotation of the motor rotatably drives the threaded shaft, thereby moving the nut along the guide in the bracket. Movement of the nut along the guide in the bracket causes the arm to pivot, thereby raising and lowering the window.

In a second embodiment according to the present invention, a window glass is supported by a first support and a second support. Preferably, the first and second supports are positioned adjacent the structural supports in the door, which in the front door are the A and B pillars, respectively. First and second linear displacement devices are secured to the first and second supports, respectively. The first and second linear displacement devices are mounted generally parallel to the direction of travel of the window glass.

As a result, the first and second linear displacement devices are mounted adjacent the A and B pillars respectively. There is no window support hardware generally near the center of the door which could interfere with the mounting of a side-impact air bag.

A single motor preferably drives both the first and second linear displacement devices. Preferably, each linear displacement device comprises a threaded shaft threadably engaging the supports, such that rotation of the threaded shaft causes a support to raise and lower the window.

Preferably, the motor is mounted near a lower edge of the door. A rotary cable extends from either axial end of the motor to drive each threaded shaft. Preferably, a spur gear is secured to the end of each cable and engages a face gear mounted on an end of each threaded shaft.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
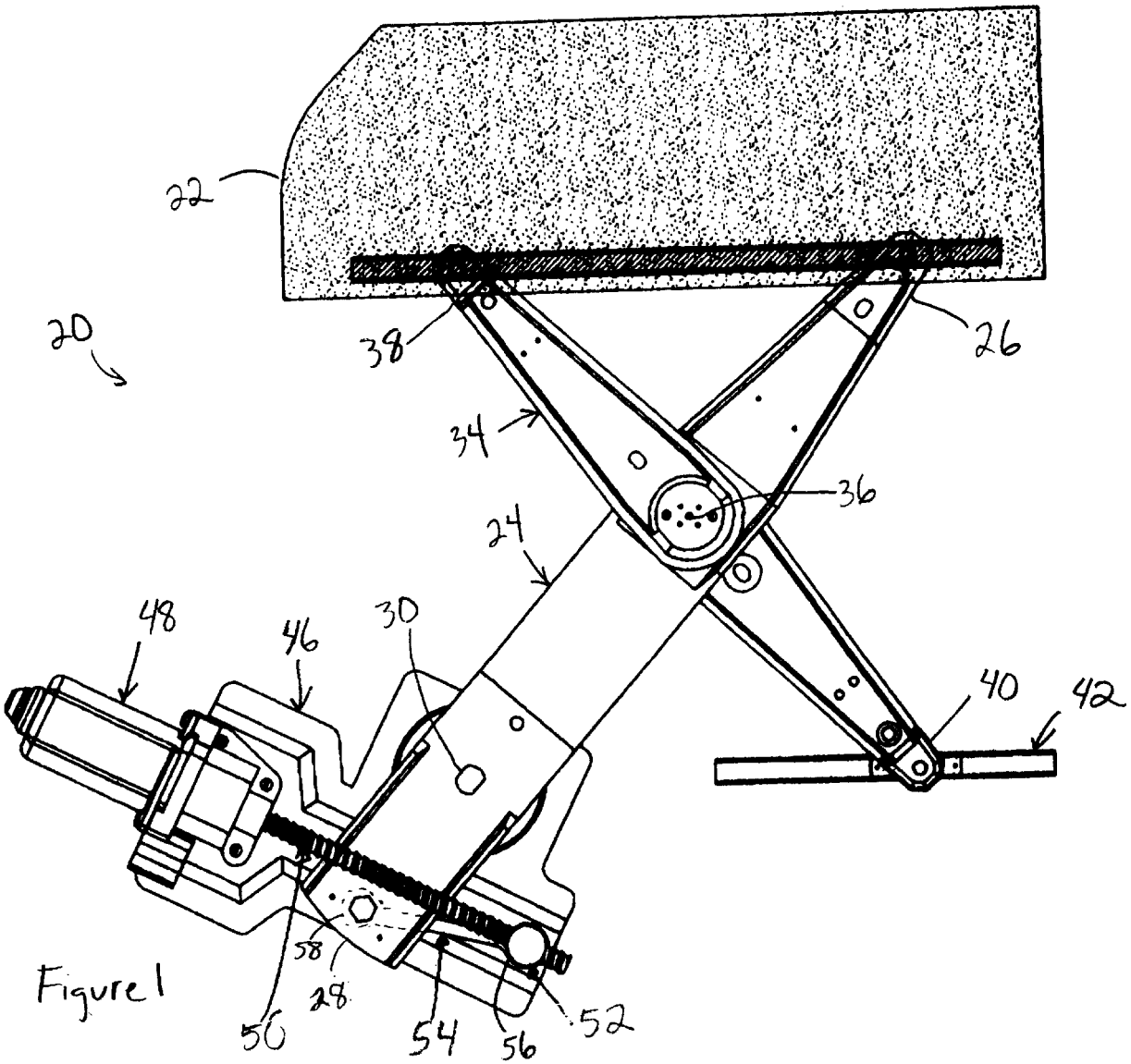
FIG. 1 is a window lift system of the present invention.

The present invention provides a window lift system 20 for raising and lowering a window glass 22, such as in a vehicle door. The window lift system 20 is generally of the type having a first arm 24 having a first end 26 supporting the window glass 22 and an opposite second end 28, wherein the first arm 24 includes a pivot point 30 between the first end 26 and second end 28 about which the first arm 24 pivots to raise and lower the window glass 22. A second arm 34 is pivotally mounted to the first arm 24 and a second pivot point 36. The second arm 34 includes a first end 38 supporting the window glass 22 and an opposite second end 40 pivotally mounted to a slide 42 which moves forwardly and rearwardly during the raising and lowering of the window glass 22.

The window lift system 20 of the present invention provides a bracket 46 to which the first arm 24 is pivotally mounted. A motor 48 is mounted to the bracket 46 and rotatably drives a threaded shaft 50 or screw via a gear unit 51. The threaded shaft 50 threadably engages a threaded slide 52, secured to but movable relative to the bracket 46 as will be described in further detail below. The slide 52 is preferably an internally threaded polymer core nut 52. A link 54 includes a first end 56 pivotally mounted to the slide 52 and a second end 58 pivotally mounted to the second end 28 of the first arm 24.

Figure 2:
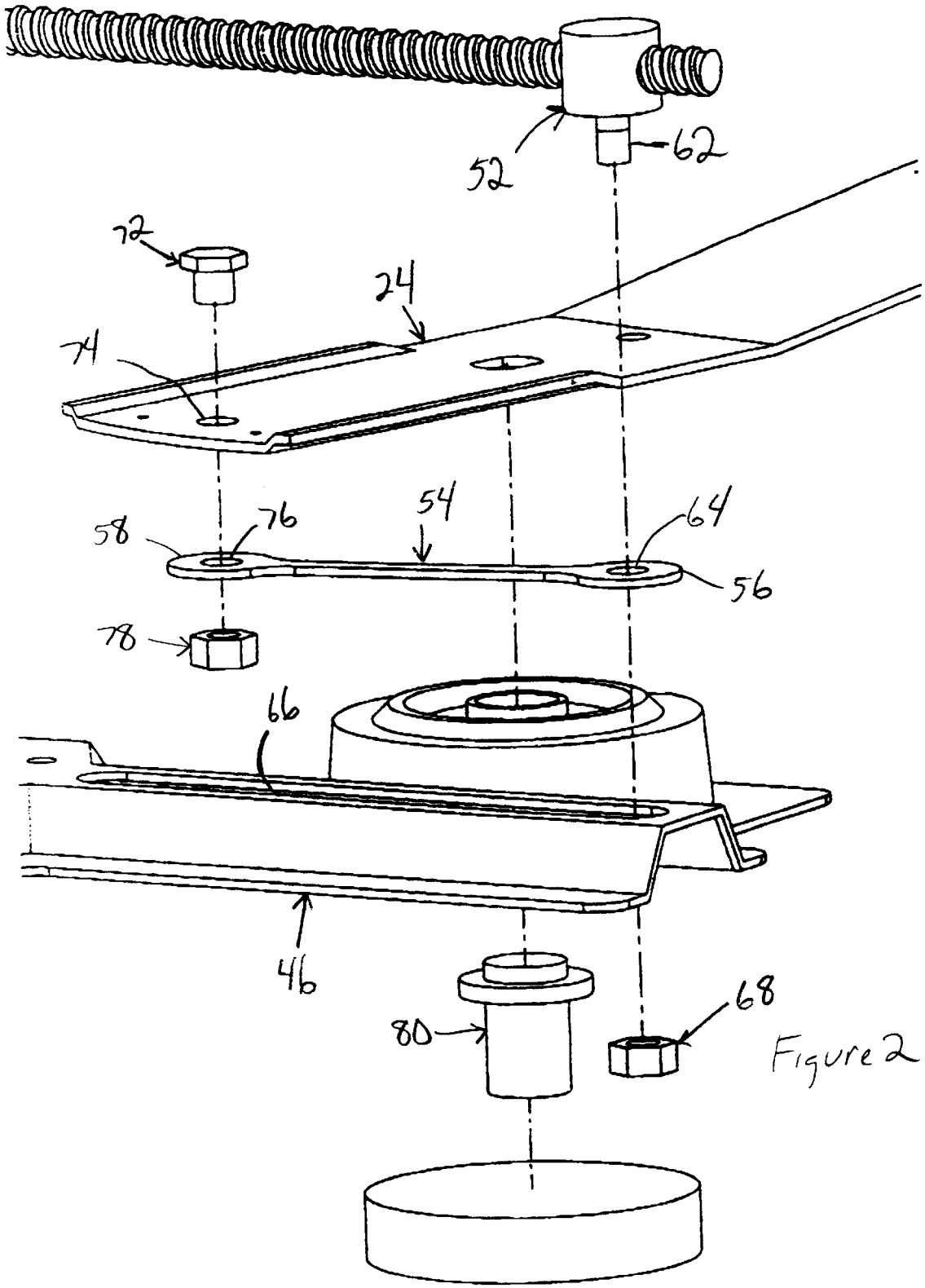
FIG. 2 is an exploded view of the window lift system of FIG. 1.

As can be seen in FIG. 2, the slide 52 preferably includes a pivot pin 62 extending downwardly through an aperture 64 in the first end 56 of the link 54. The pivot pin 62 also extends into an elongated guide 66, which is a slot through the bracket 46. The pivot pin 62 is secured to the bracket 46 by a nut 68 or other fastener.

A bolt 72 is inserted through an aperture 74 in the second end 28 of the first arm 24, through an aperture 76 in the second end 58 of the link 54 and secured by a nut 78, or other fastener. The first arm 24 is pivotally mounted to the bracket 46 by a pin 80.

Figure 3:
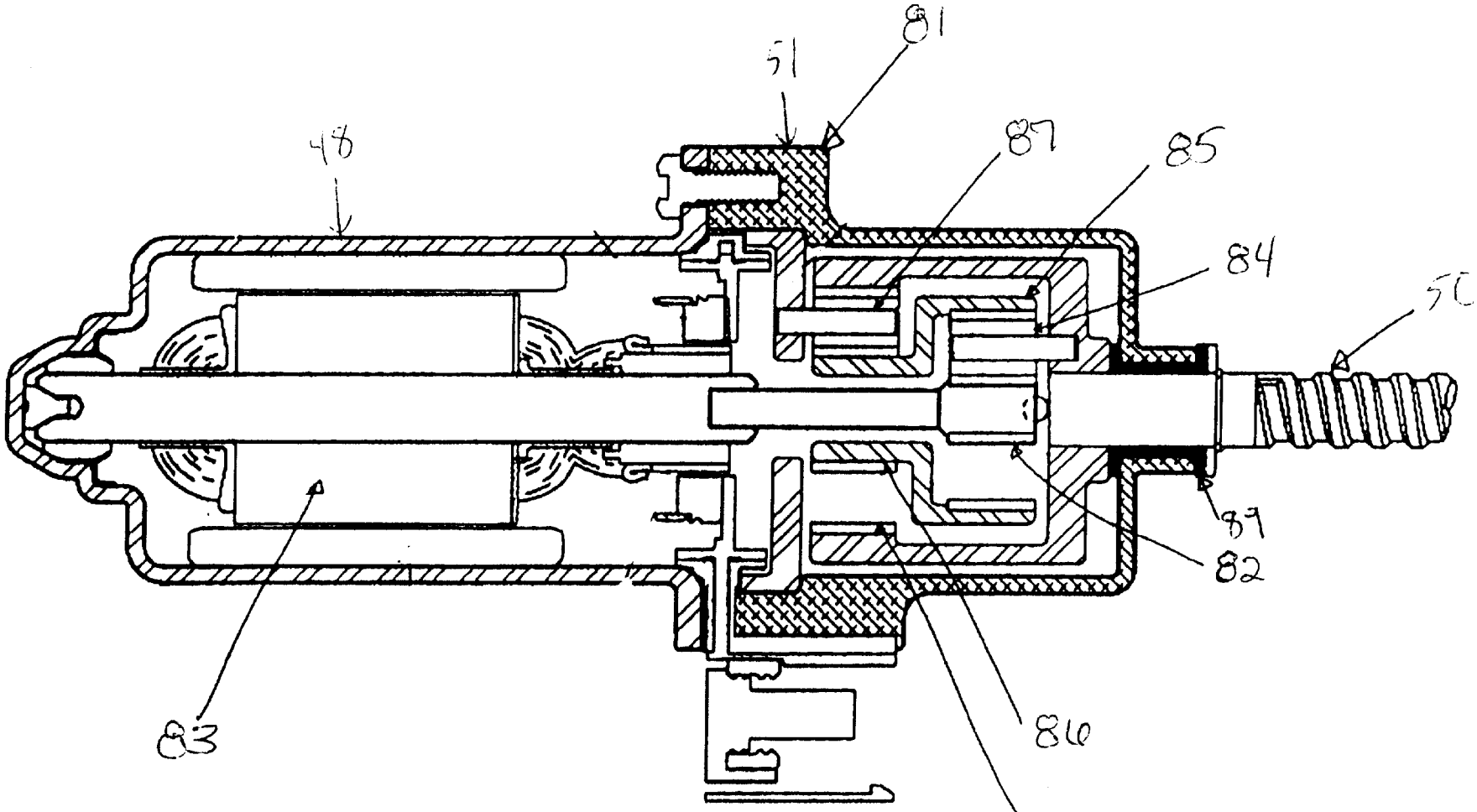
FIG. 3 is a sectional view of the motor and gear unit of FIG. 1, taken along line 3—3.

As can be seen in FIG. 3, the gear unit 51 generally comprises a gear housing 81 mounted to the motor 48. The gear unit 51 further includes a stage one sun gear 82 coupled to the armature 83 of the motor 48. The stage one sun gear 82 engages a stage one planet gear 84 which in turn engages a stage one ring gear 85. The stage one ring gear 85 engages a stage two sun gear 86 which engages a stage two planet gear which is fixedly mounted relative to the gear housing 81. The stage two planet gear 87 engages a stage two ring gear 88 which drives the threaded shaft 50 which is supported in the gear housing 81 by a bearing 89.

In operation, rotation of the threaded shaft 50 by the motor 48 causes linear displacement of the slide 52 along guide 66 of the bracket 46. The slide 52 engages the second end 28 of the first arm 24 via the link 54, thereby causing the first arm 24 to pivot about pivot point 30 in bracket 46 and raising or lowering the first end 26 of the first arm 24 and the window glass 22. As is well known, as the first end 26 of the first arm 24 is raised and lowered, the first end 38 of the second arm 34 raises and lowers in a similar fashion. During operation, the threaded shaft 50 has many threads in contact with slide 52, thereby increasing reliability of the window lift system 20. Further, the efficiency of the window lift system is high compared to existing systems, due to the efficiency of the threaded shaft 50 engagement with slide 52. The window lift system 20 is also quieter than existing systems, because the driving engagement between the threaded shaft 50 and slide 52 will generate high frequency noise which can easily be damped. Further, the cost of the window lift system 20 is less than the existing systems because the number of parts is reduced and complicated parts are eliminated.

Figure 4:
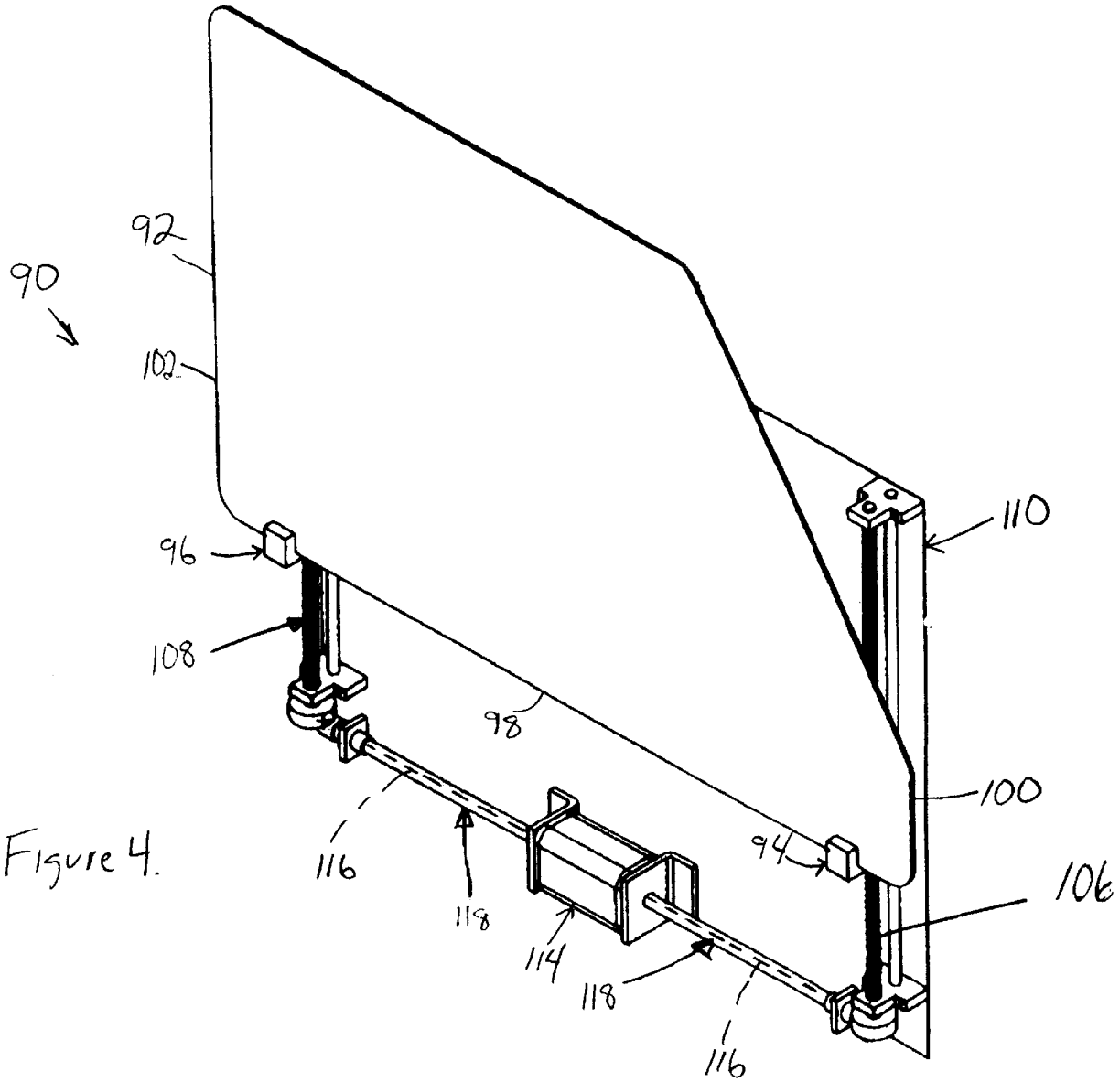
FIG. 4 is a perspective view of a window lift system according to a second embodiment of the present invention.

A window lift system 90 for raising and lowering a window glass 92 according to another embodiment of the present invention is shown in FIG. 4. The window lift system 90 generally comprises a forward support 94 and rearward support 96 engaging a bottom edge 98 of the window glass 92. The forward and rearward supports 94, 96 are positioned adjacent forward and rearward edges 100, 102, respectively, of the window glass 92. Each of the supports 94, 96 is threadably engaged by a threaded shaft 106, 108 respectively. The threaded shafts 106, 108 or screws, are rotatably mounted to a door trim panel 110. Rotation of the threaded shafts 106, 108 causes raising or lowering of the supports 94, 96 and window glass 92.

Figure 5:
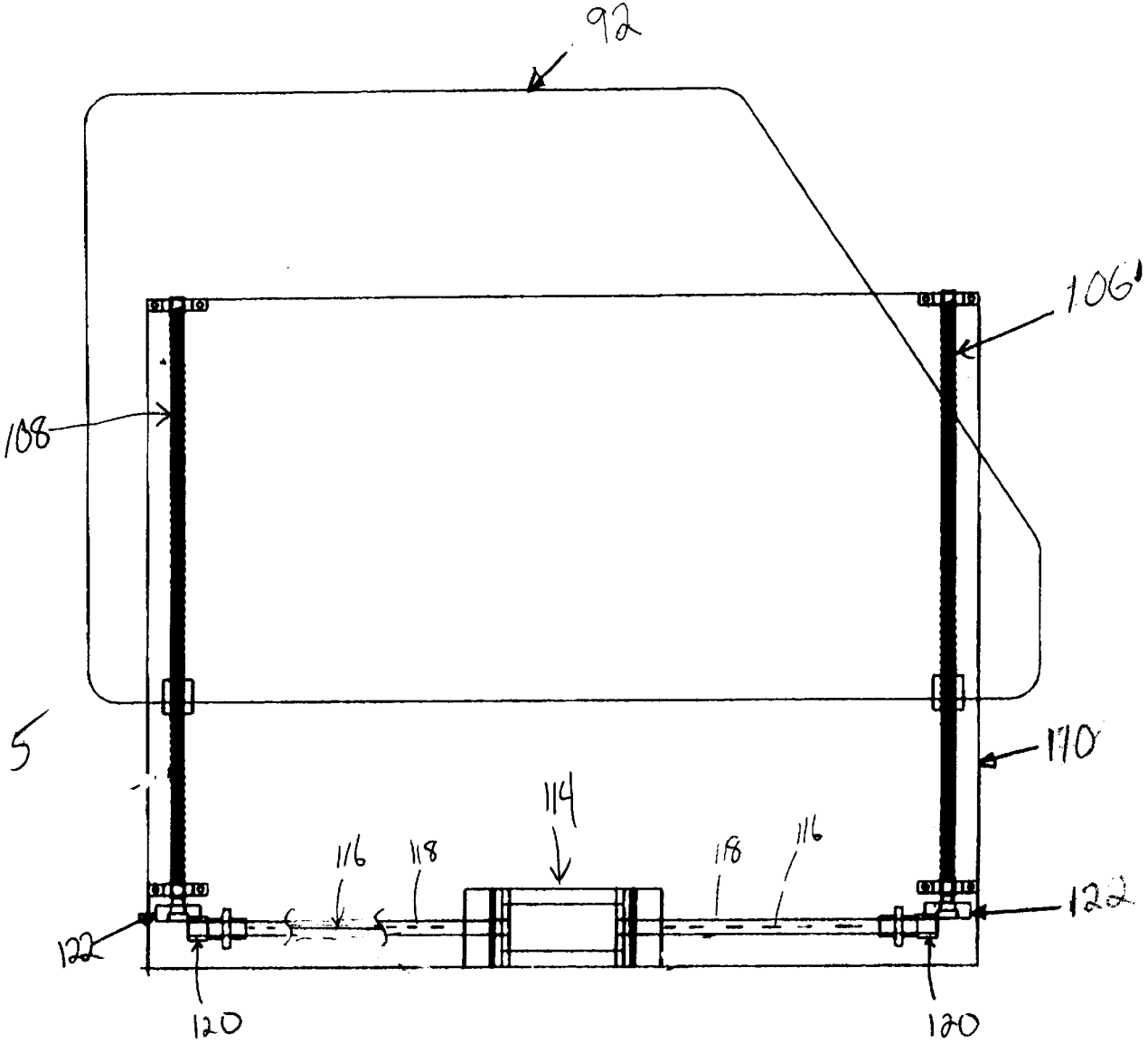
FIG. 5 is a side view of the window lift system of FIG. 4.
Figure 1:
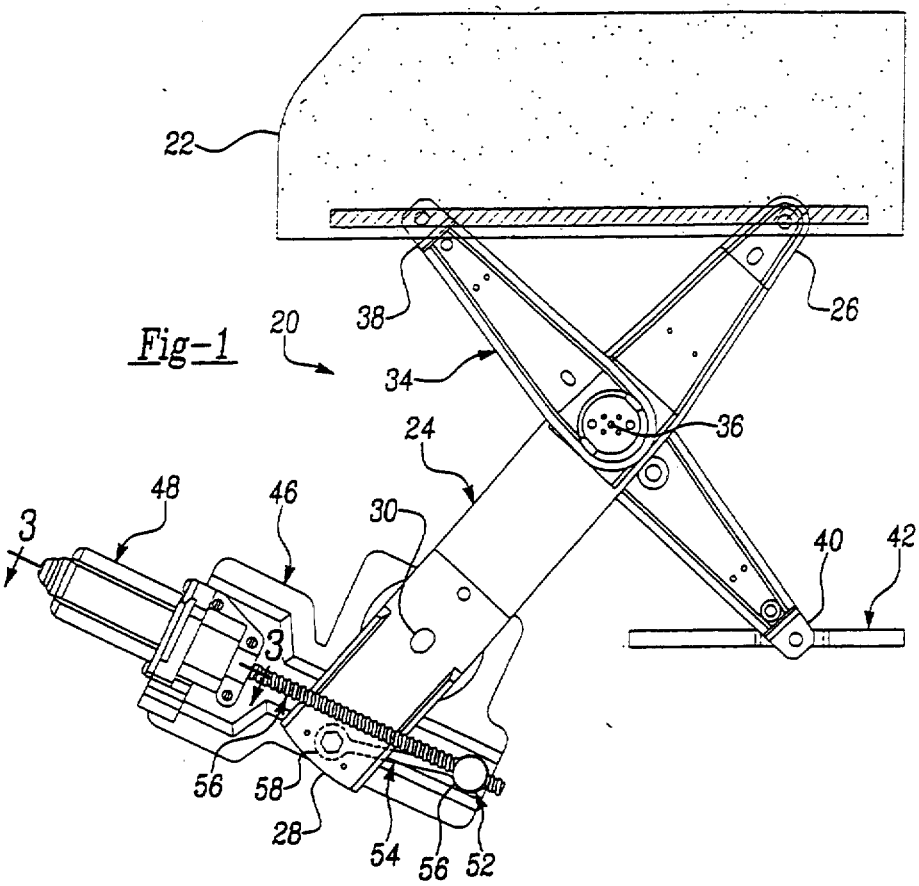
Figure 3:
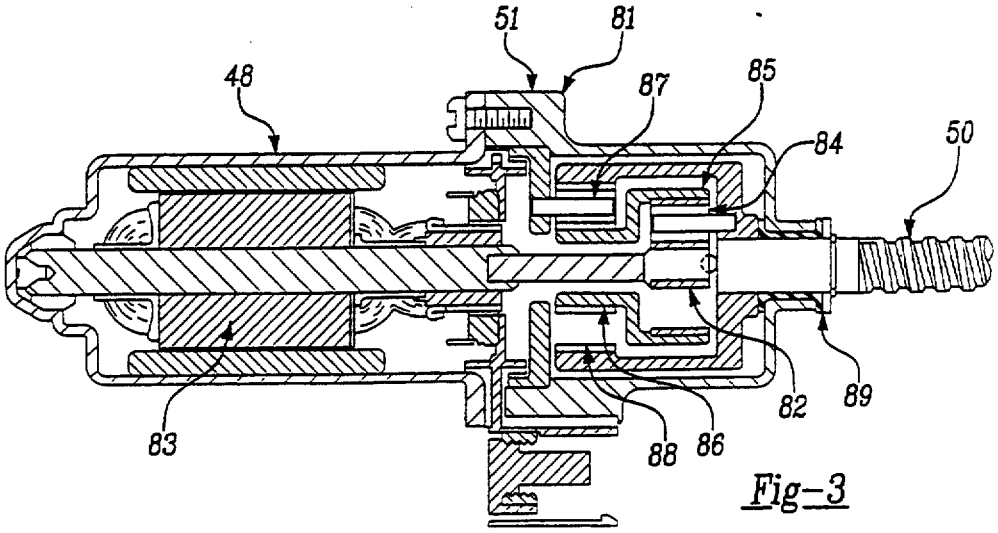
Figure 2:
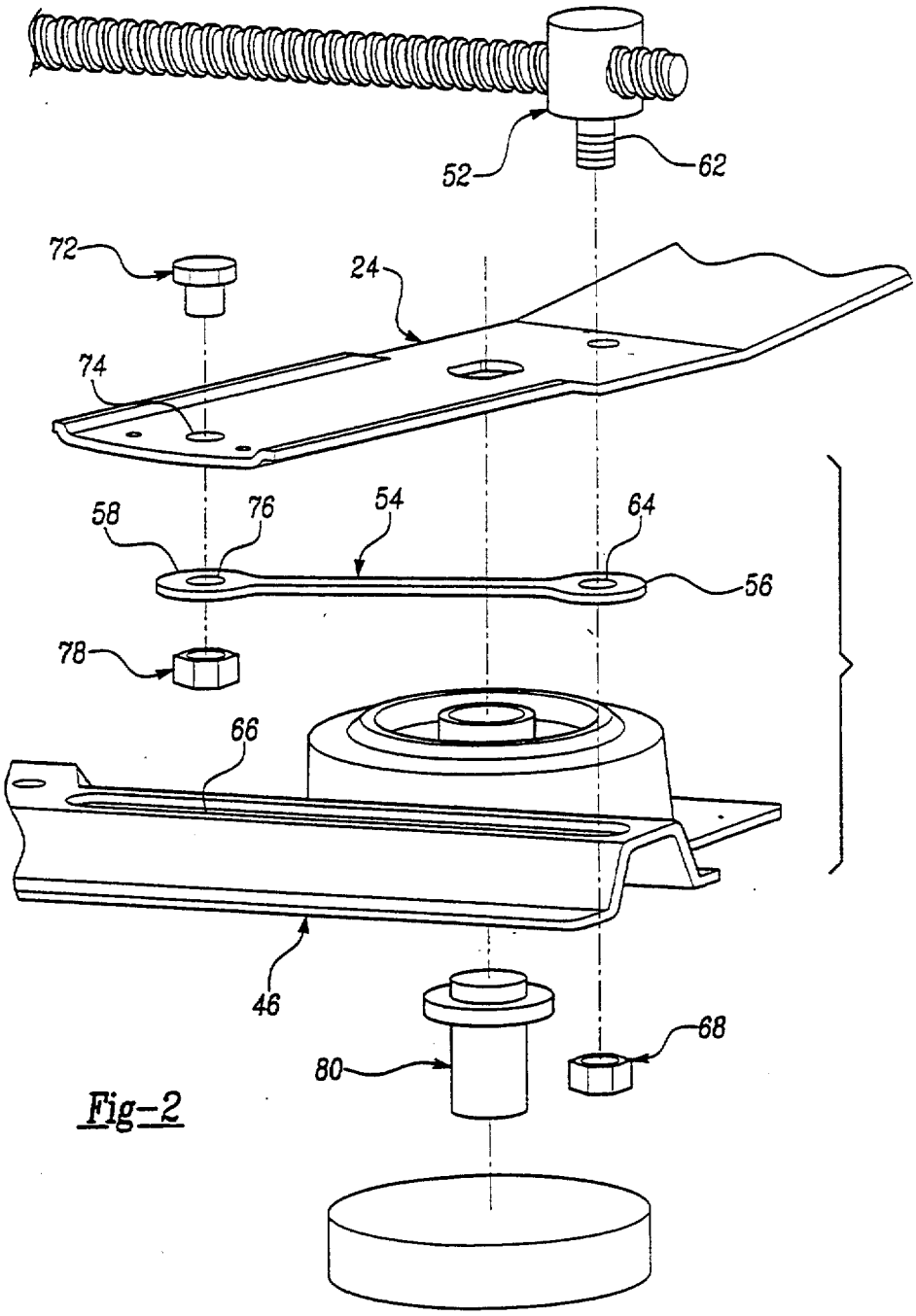
Figure 4:
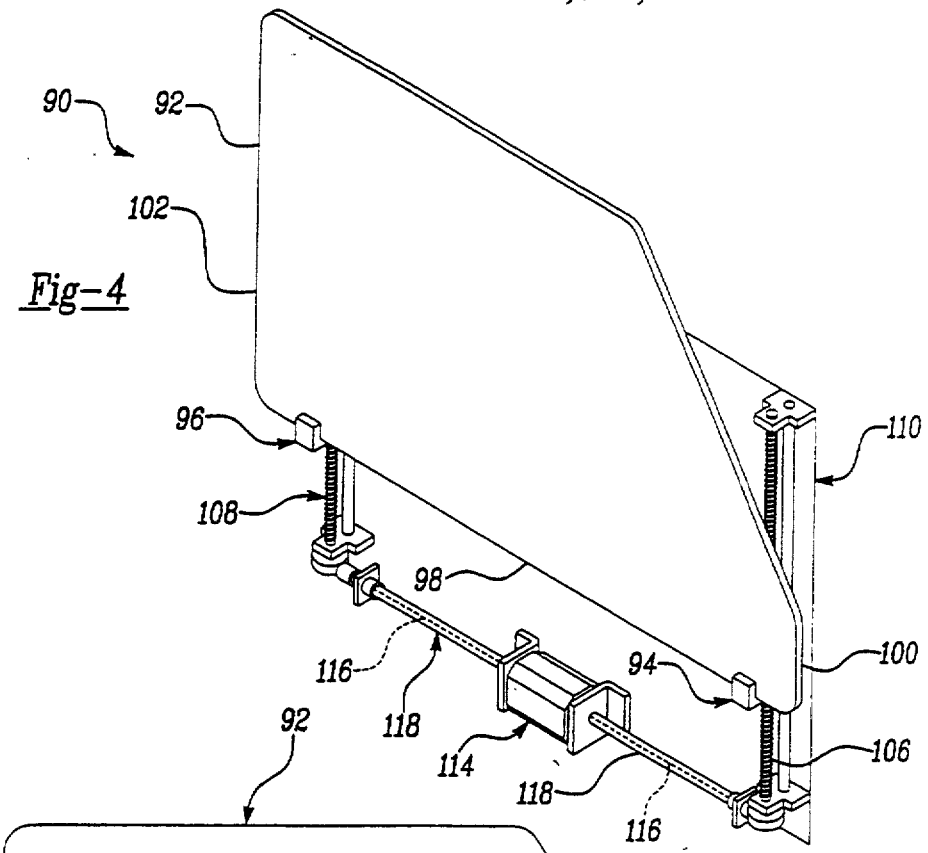
Figure 5:
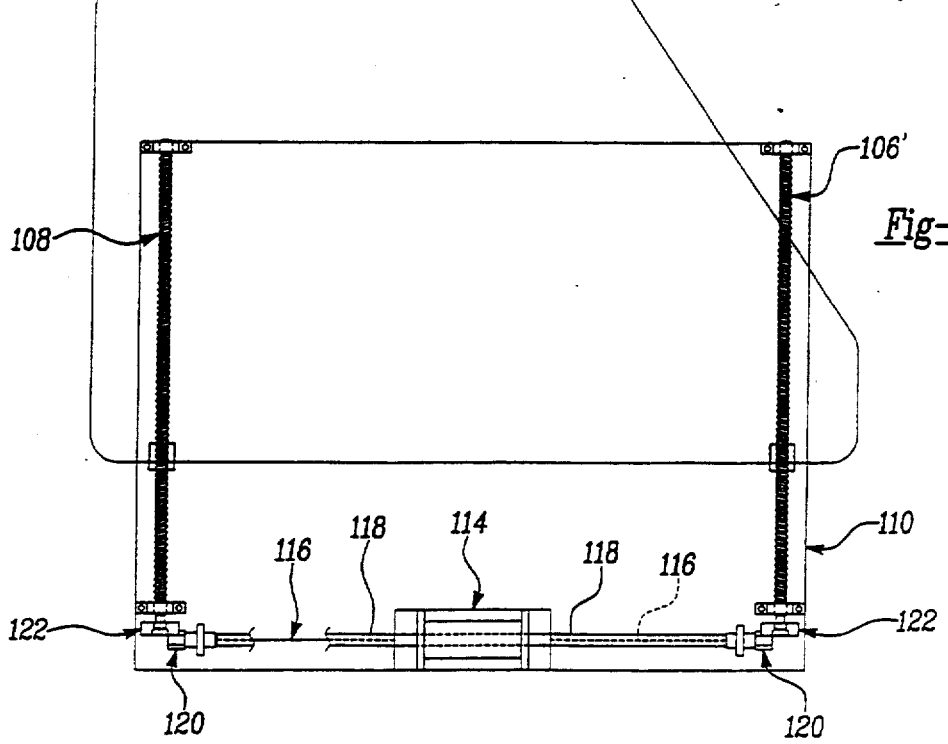

Preferably, a single motor 114 drives both threaded shafts 106, 108. The motor 114 is preferably mounted adjacent a lower edge of the door trim panel 110. The motor 114 rotatably drives a pair of rotary cables 116 extending from either axial end of the motor 114. The cables 116 are mounted in conduit 118. As can be seen in FIG. 5, each of the cables 116 rotatably drives a spur gear 120 which engages a face gear 122 mounted at a lower end of each threaded shaft 106, 108.

In operation, the motor 114 rotatably drives cables 116 and spur gears 120. Spur gears 120 rotatably drive face gears 122 and therefore threaded shafts 106, 108. Rotation of threaded shafts 106, 108 causes the raising and lowering of supports 94, 96 and therefore window glass 92.

Since the drive mechanisms, i.e. the threaded shafts 106, 108 and supports 94, 96, are positioned adjacent the forward edge 100 and rearward edge 102 of the window glass 92, they will also be positioned close to the A and B pillars in the door. In the window lift system 90, there are no mechanisms between the A and B pillars that can interfere with the mounting of side-impact air bags. It should be apparent that the threaded shafts 106, 108 could be replaced with other linear displacement devices, such as belt drive systems. Further, although the window lift system 90 preferably utilizes a single motor 114 in order to reduce costs, more than one motor could also be used.

Preferably the motor 48 includes a gear unit which selectively provides one of a plurality of gear ratios, such that the speed of the armature shaft can be reduced and torque can be increased.

In accordance with the provisions of the patent statutes, the present invention has been described in what is considered to represent a preferred embodiment. However, it should be noted that the invention can be practiced otherwise than as specifically illustrated and described without departing from its spirit or scope.

What is claimed is:

1. A window lift system comprising:

a motor rotatably driving a threaded shaft;

an arm pivotally supported between a first end for supporting a window glass and a second end;

a threaded slide threadably engaging said shaft, said slide engaging said second end of said arm, such that rotation of said shaft causes linear displacement of said slide relative to said shaft and therefore pivotal movement of said arm.

2. The window lift system of claim 1 wherein said slide comprises an internally threaded nut.

3. The window lift system of claim 1 further comprising a bracket, said bracket defining a guide limiting movement of said slide along said guide.

4. The window lift system of claim 3 wherein said guide is a slot in said bracket, said slide including a portion extending into said slot.

5. The window lift system of claim 4 wherein said arm is pivotally mounted to said bracket and said motor is mounted to said bracket.

6. The window lift system of claim 1 wherein said arm is a first arm, said window lift system including a second arm having a first end for supporting a window glass and a slidably mounted opposite second end.

7. The window lift system of claim 1 further including a gear unit coupling said motor to said threaded shaft, said gear unit providing a plurality of gear ratios between said motor and said threaded shaft.

* * * * *

UNITED STATES PATENT AND TRADEMARK OFFICE

CERTIFICATE OF CORRECTION

PATENT NO. : 6,003,268

DATED : 12/21/99

INVENTOR(S) : RAGHU K. ORUGANTY

It is certified that error appears in the above-identified patent and that said Letters Patent is hereby corrected as shown below:

On the Title page, item [75] Inventor, "Raghn" should read –Raghu–;

The Title page, showing an illustrative figure should be deleted and substitute therefore the attached title page.

Delete drawing sheets 1-5 and substitute therefor the drawing sheets consisting of Figs. 1-5, as shown on the attached pages.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,003,268

DATED : December 21 1999

INVENTOR(S) : Raghu K. Oruganty

It is certified that error appears in the above-identified patent and that said Letters Patent is hereby corrected as shown below:

Claim 1 should read as follows:

1. A window lift system comprising:

a motor rotatably driving a threaded shaft;

an arm pivotally supported at a fixed location between a first end for supporting a window glass and a second end; and a threaded slide threadably engaging said shaft, a link having a first end pivotally mounted to said slide and an opposite second end pivotally mounted to said second end of said arm, said slide engaging said second end of said arm through said link, such that rotation of said shaft causes linear displacement of said slide relative to said shaft and therefore pivotal movement of said arm through said link.

US006003268A

United States Patent [19]

Oruganty

[11] Patent Number: 6,003,268

[45] Date of Patent: Dec. 21, 1999

[54] WINDOW LIFT SYSTEM

[75] Inventor: Raghu K. Oruganty, Belleville, Mich.

[73] Assignee: UT Automotive Dearborn, Inc., Dearborn, Mich.

[21] Appl. No.: 08/890,189

[22] Filed: Jul. 9, 1997

[51] Int. Cl.[6] ..... E05F 11/44

[52] U.S. Cl. ..... 49/351; 49/349

[58] Field of Search ..... 49/351, 350, 349, 49/348, 502

[56] References Cited

U.S. PATENT DOCUMENTS

| | | | |
|---|---|---|---|
| 1,654,747 | 1/1928 | Nicholson | 49/351 |
| 2,115,632 | 4/1938 | Hanley | 268/132 |
| 2,336,530 | 12/1943 | Chandler et al. | 268/124 |
| 2,883,780 | 4/1959 | Goodman | 39/6 |
| 4,119,341 | 10/1978 | Cook | 296/146 |
| 4,170,847 | 10/1979 | Pickles | 49/349 |
| 4,235,117 | 11/1980 | Pickles | 74/89.2 |
| 4,353,185 | 10/1982 | Saigne | 49/351 |
| 5,015,030 | 5/1991 | Detloff | 49/351 X |
| 5,101,596 | 4/1992 | Moore | 49/351 |
| 5,337,519 | 8/1994 | Bergesio | 49/351 |

FOREIGN PATENT DOCUMENTS

| | | | |
|---|---|---|---|
| 944860 | 12/1963 | United Kingdom | 49/351 |

*Primary Examiner*—Jerry Redman
*Attorney, Agent, or Firm*—Howard & Howard

[57] ABSTRACT

A window lift system generally comprises a motor driving a threaded shaft threadably engaging a nut slidably mounted in a bracket. A link has a first end rotatably mounted to the nut and a second end rotatably mounted to an end of a pivotally mounted arm. An opposite end of the arm engaging the window glass raises and lowers the window glass as the arm pivots.

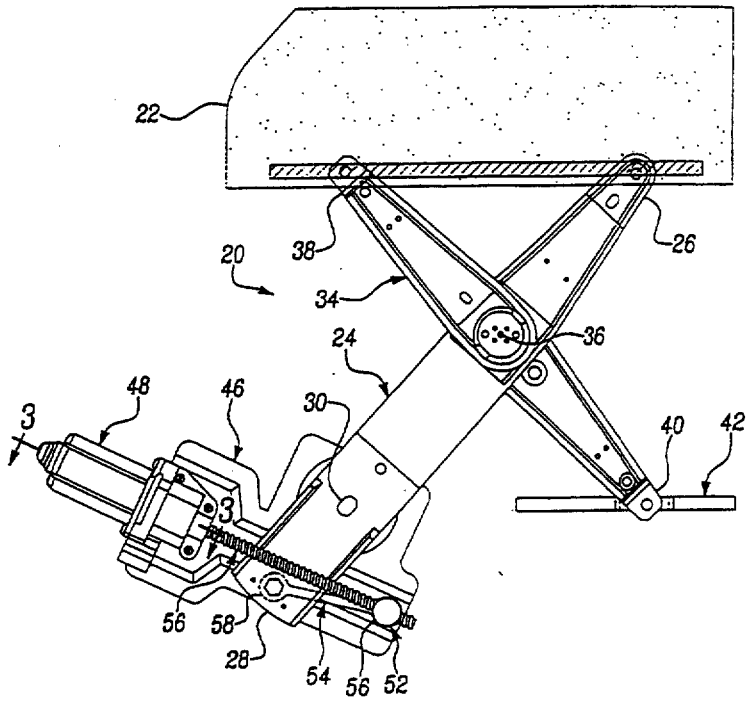

7 Claims, 5 Drawing Sheets